US012660943B2

(12) United States Patent
Ventola et al.

(10) Patent No.: US 12,660,943 B2
(45) Date of Patent: Jun. 23, 2026

(54) ACTIVITY FLOOR SEAT

(71) Applicant: Skip Hop, Inc., New York, NY (US)

(72) Inventors: Vincent Ventola, Fort Lee, NJ (US); Sierra Seip, Newburgh, NY (US); Adlin Aslan, New York, NY (US); Matthew Lauderbach, Belford, NJ (US)

(73) Assignee: Skip Hop, Inc., New York, NY (US)

( * ) Notice: Subject to any disclaimer, the term of this patent is extended or adjusted under 35 U.S.C. 154(b) by 230 days.

(21) Appl. No.: 18/222,232

(22) Filed: Jul. 14, 2023

(65) Prior Publication Data

US 2025/0017393 A1 Jan. 16, 2025

(51) Int. Cl.

| | |
|---|---|
| ***A47D 1/00*** | (2006.01) |
| ***A47D 13/10*** | (2006.01) |
| ***A47D 15/00*** | (2006.01) |

(52) U.S. Cl.

CPC ..... *A47D 1/006* (2013.01); *A47D 13/107* (2013.01); *A47D 15/00* (2013.01)

(58) Field of Classification Search

CPC ..... A47D 1/006; A47D 1/02; A47D 13/02; A47D 13/107

See application file for complete search history.

(56) References Cited

U.S. PATENT DOCUMENTS

| | | | | |
|---|---|---|---|---|
| 4,359,045 | A * | 11/1982 | Cozzi | A47D 15/006 601/24 |
| 5,172,955 | A * | 12/1992 | Freese | A47D 13/107 248/608 |
| 7,854,476 | B1 * | 12/2010 | Liu | A47D 1/103 297/181 |
| 10,653,250 | B1 * | 5/2020 | Flannery | A47C 7/002 |
| 11,576,499 | B1 * | 2/2023 | Skilnick | A47D 1/004 |
| 11,889,930 | B1 * | 2/2024 | Bastien | A47D 13/102 |
| 2003/0020317 | A1 * | 1/2003 | Keegan | A47D 9/012 297/446.2 |
| 2005/0225137 | A1 * | 10/2005 | Mead | A47D 13/107 297/250.1 |
| 2008/0054696 | A1 * | 3/2008 | McConnell | A47D 15/006 297/256.15 |

(Continued)

FOREIGN PATENT DOCUMENTS

| | | | | |
|---|---|---|---|---|
| CN | 112056864 | A * | 12/2020 | A47D 1/002 |
| CN | 114601293 | A * | 6/2022 | A47D 1/02 |

(Continued)

OTHER PUBLICATIONS

Staranddaisy 2-in-1 premium modern automatic electric baby swing rocker cradle with detachable dining tray & mosquito net, baby rocker with smart touch panel & bluetooth enabled music and remote control & urine mat, retrieved Jul. 26, 2022 from https://staranddaisy.in/product/staranddaisy-baby-swing-rocker-for-infants-with-5-natural-sway-speeds-bluetooth-music-baby-bouncer-with-remote-control-for-2-10-kg-0-18-months-dining-tray-mosquito-net-and-urine-mat-grey, 9 pp.

*Primary Examiner* — Timothy J Brindley

(74) *Attorney, Agent, or Firm* — Greenberg Traurig, LLP

(57) ABSTRACT

An apparatus according to the disclosure herein includes a central structure having a loop portion and a base portion. a pommel coupled to the base portion and positioned within the loop portion. and a cover configured to couple to the loop portion to define a seat, the cover positioned between the base portion and the pommel.

19 Claims, 16 Drawing Sheets

(56) References Cited

U.S. PATENT DOCUMENTS

| | | | | |
|---|---|---|---|---|
| 2014/0068859 | A1* | 3/2014 | Alegria | A47D 13/10 5/655 |
| 2018/0279799 | A1* | 10/2018 | Ingraham | A47D 1/006 |
| 2023/0263316 | A1* | 8/2023 | Herrin | A47D 13/107 297/260.1 |
| 2024/0016306 | A1* | 1/2024 | Lange | A47D 1/002 |

FOREIGN PATENT DOCUMENTS

| | | | | | |
|---|---|---|---|---|---|
| DE | 202008002845 | U1 | | 5/2008 | |
| EP | 3039995 | A | | 7/2016 | |
| GB | 2107975 | A | * | 5/1983 | A47D 1/002 |
| GB | 2355923 | A | * | 5/2001 | A47D 13/107 |
| GB | 2480948 | B | | 1/2012 | |
| WO | WO-2024243477 | A1 | * | 11/2024 | |

* cited by examiner

ACTIVITY FLOOR SEAT

BACKGROUND

Conventionally, seats for children are typically high-chairs that are elevated in order for seated children to be present at the same level as adults, for example, at a dinner table. Any lower or floor-based seats are not standalone seats, or provide some ancillary function like rocking.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

A first aspect of the present disclosure is directed to an apparatus having a central structure having a loop portion and a base portion. a pommel coupled to the base portion and positioned within the loop portion. and a cover configured to couple to the loop portion to define a seat, the cover positioned between the base portion and the pommel.

A second aspect of the present disclosure is directed to an activity seat having a loop structure having a top side, a bottom side, a left side, and a right side. and a support bar extending rearwards from the loop structure, the support bar being substantially U-shaped and having a right end, a left end, and a base portion. In this aspect, the right end of the support bar couples to the right side of the loop structure, the left end of the support bar couples to the left side of the loop structure, and the bottom side of the loop and the base portion of the support bar are together configured to rest on a surface to support the activity seat.

A third aspect of the present disclosure is directed to floor-level activity seat having a central structure having a loop portion and a base portion. a support bar extending rearwards from the loop portion, the support bar having a left end coupled to a left side of the loop portion and a right end coupled to a right side of the loop portion. a pommel coupled to the base portion and positioned within the loop portion. and a fabric cover configured to removably couple to the loop portion to define a seat, the fabric cover positioned between the base portion and the pommel.

DETAILED DESCRIPTION

Reference will now be made in detail to various embodiments, examples of which are illustrated in the accompanying drawings. While this disclosure includes certain embodiments, it will be understood the disclosure is not intended to limit the claims to these embodiments. On the contrary, the disclosure is intended to cover alternatives, modifications and equivalents, which may be included within the spirit and scope of the claims. Furthermore, in this detailed description, numerous specific details are set forth in order to provide a thorough understanding. However, one of ordinary skill in the art will appreciate that the subject matter of the present disclosure may be practiced without these specific details. In other instances, well known methods, procedures, and components have not been described in detail as not to unnecessarily obscure aspects of the present disclosure.

Various embodiments of this disclosure include a low-style activity seat for children and toddlers that is configured to provide a floor-level chair or chair that may rest on any other type of flat surface (e.g., a surface generally normal to the force of gravity). While the embodiments described herein may refer to a floor or a floor seat, it will be understood that the various embodiments herein may rest on any suitable flat surface. The activity seat may be shaped as a substantially-continuous loop that forms the overall structure of the seat, with a rear leg support projecting from a relative middle of the loop. At the center of the loop, the activity seat may include a pommel, which may connect to the loop as part of a central projection. The pommel may include a slot or aperture for receiving one or more accessories that, when in use, would be positioned directly in front of a seated child. The slot or aperture is located at a location on the pommel where it is accessible to receive the one or more accessories while a cover is attached to the activity seat (e.g., to the frame or loop structure of the activity seat, to the pommel of the activity seat). The activity seat may also include a cover that extends across the loop and includes a hole for the pommel. As such, the cover may be held partially in place by attaching the pommel into the loop on top of the cover. In some embodiments, the cover may be monolithically formed with the loop structure, such that the seat may include this monolithic structure with the legs for support.

Figure 1:
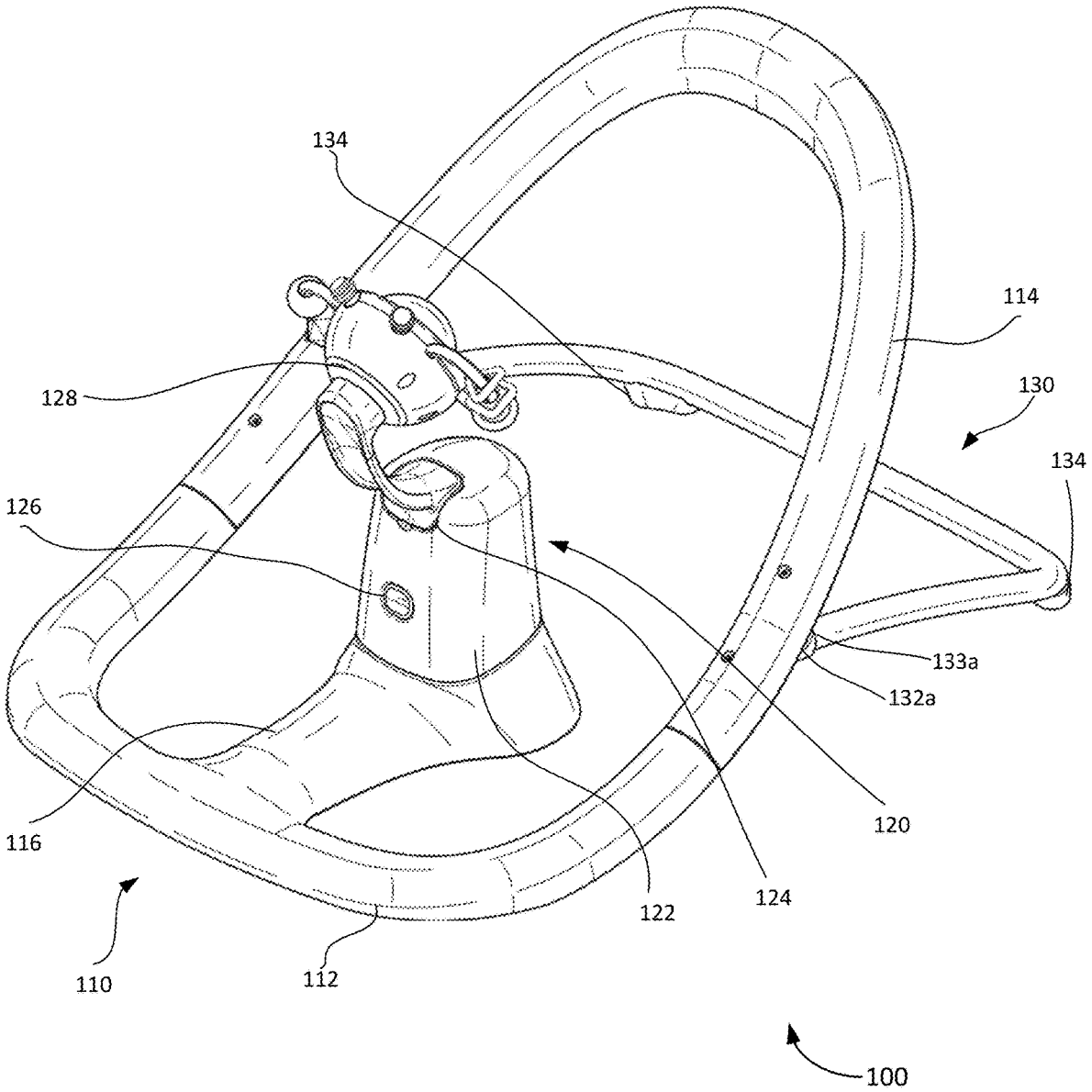
FIG. 1 is a perspective view of an activity floor seat.
Figure 12:
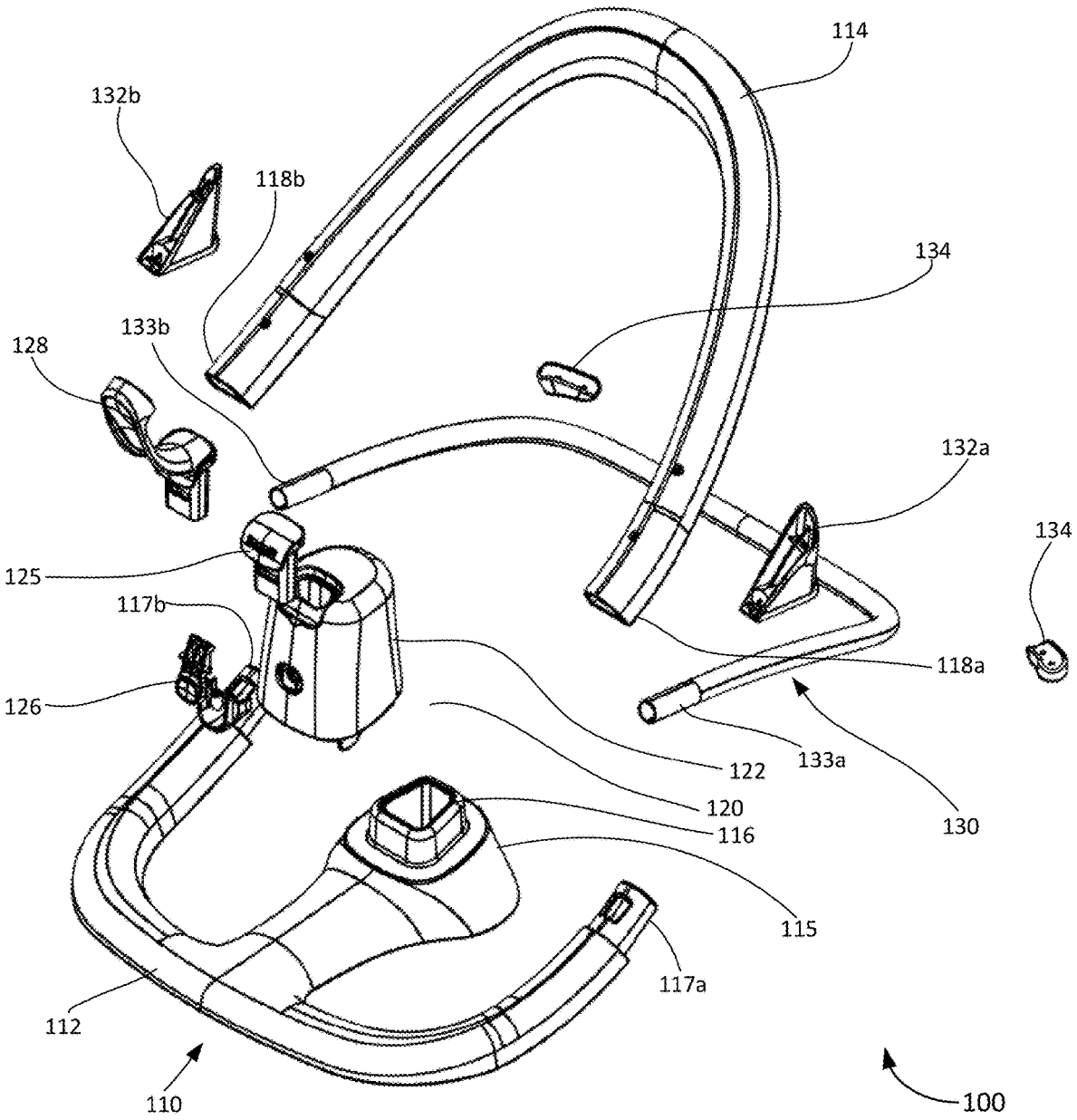
FIG. 12 is an exploded view of the activity floor seat of FIG. 1.

FIGS. 1-7 are various views of an example embodiment of an activity floor seat 100. As shown in FIG. 1, the example floor seat 100 may include a loop structure 110, a pommel 120, and a rear support 130. The loop structure 110 may include a lower portion 112 and an upper portion 114 that may combine to form the overall loop-shape of the loop structure 110. As shown in FIG. 12, which is a partially exploded view of the floor seat 100, the lower portion 112 may include a protrusion 117*a*, 117*b* on each end that may mate with corresponding slots 118*a*, 118*b* of the upper portion 114. The loop structure 110 may also include a base 115 that may extend in a rearward direction from an inside of the lower portion 112. The lower portion 112 and the base 115 may be monolithically formed and, together, substantially W-shaped, while the upper portion 114 may be U-shaped. As shown in FIG. 12, the base 115 may include a protrusion 116 configured to receive the pommel 120. Collectively, the lower portion 112, the base 115, and the rear support 130 may each contact a same surface at a same time (e.g., are substantially planar), such that together they define a steady and stable foundation for the floor seat 100.

Figure 2:
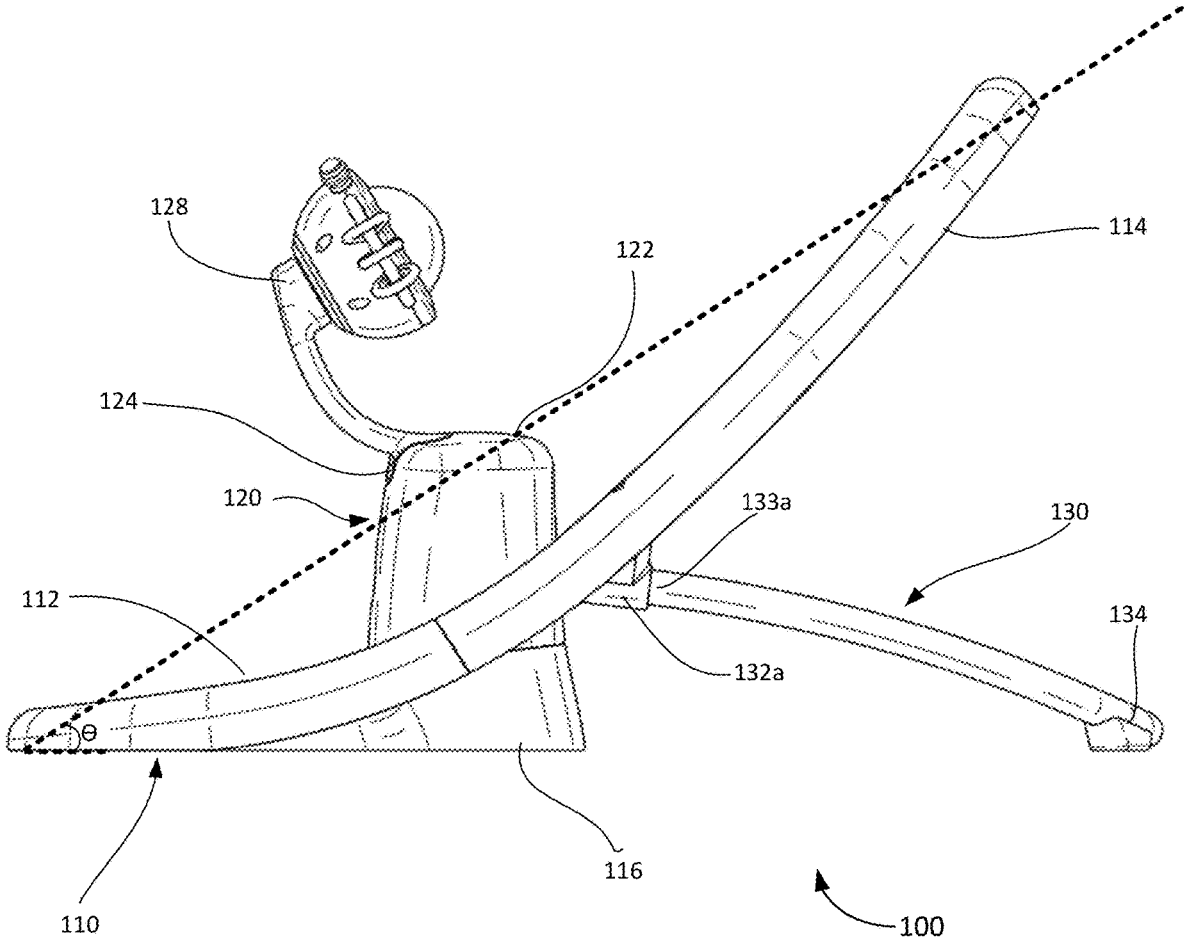
FIG. 2 is a left view of the activity floor seat of FIG. 1.
Figure 3:
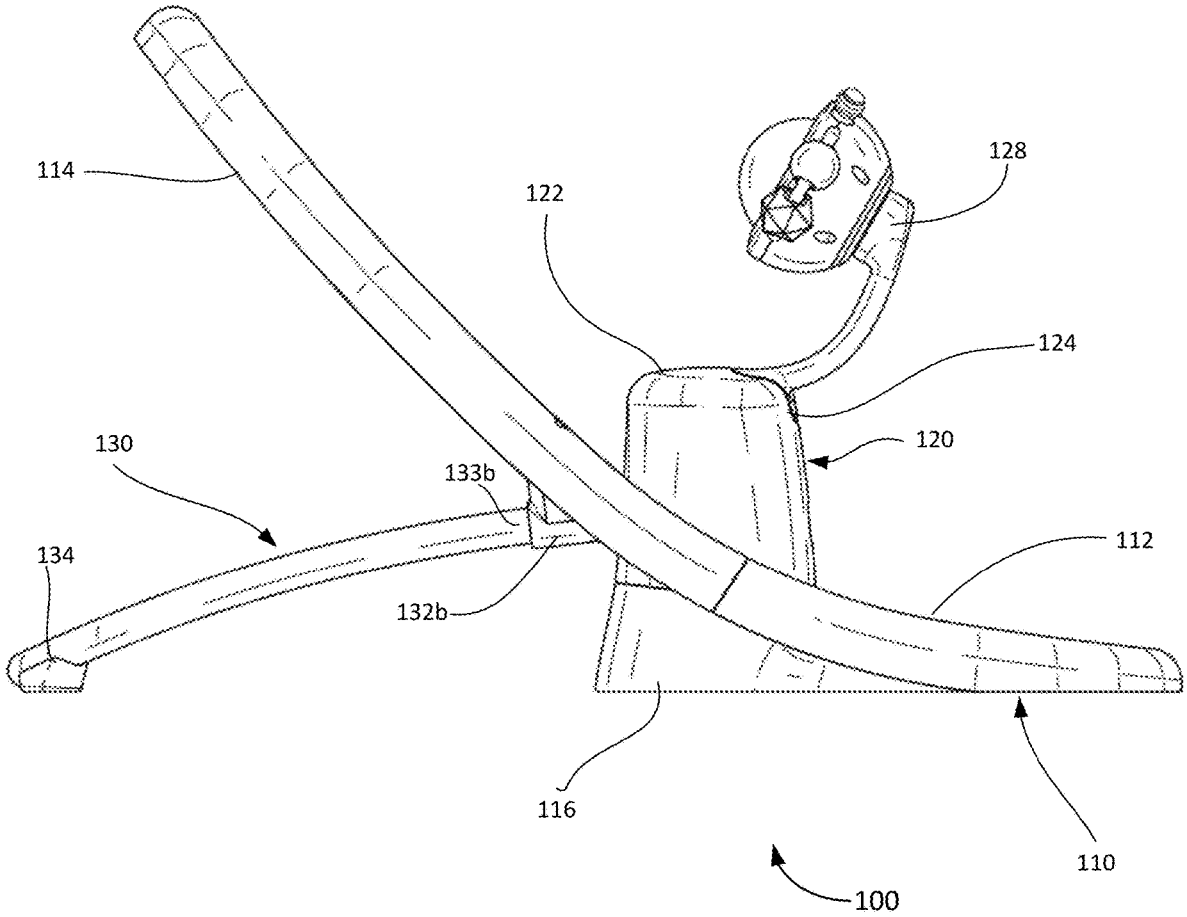
FIG. 3 is a right view of the activity floor seat of FIG. 1.
Figure 4:
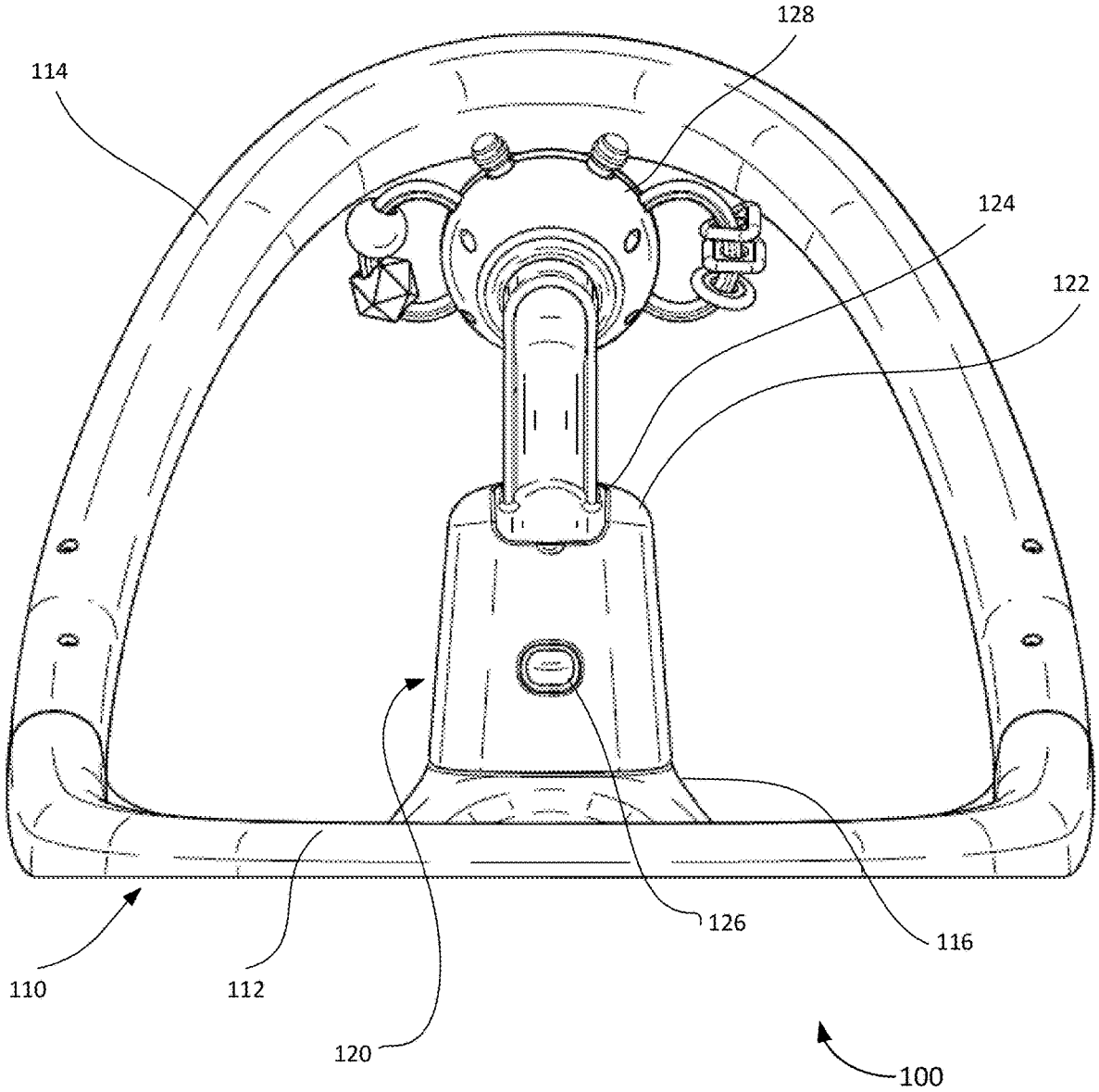
FIG. 4 is a front view of the activity floor seat of FIG. 1.
Figure 5:
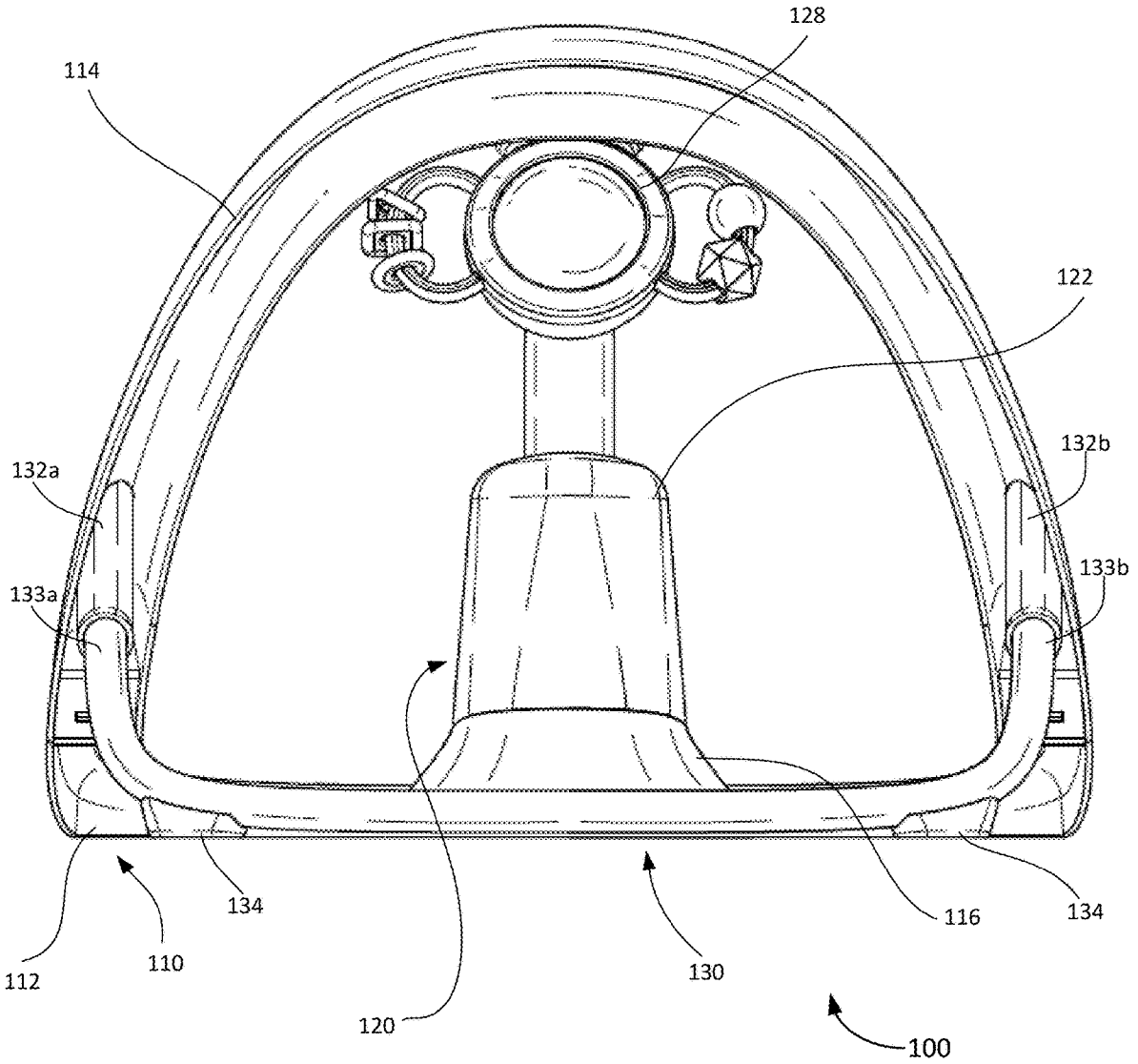
FIG. 5 is a rear view of the activity floor seat of FIG. 1.
Figure 6:
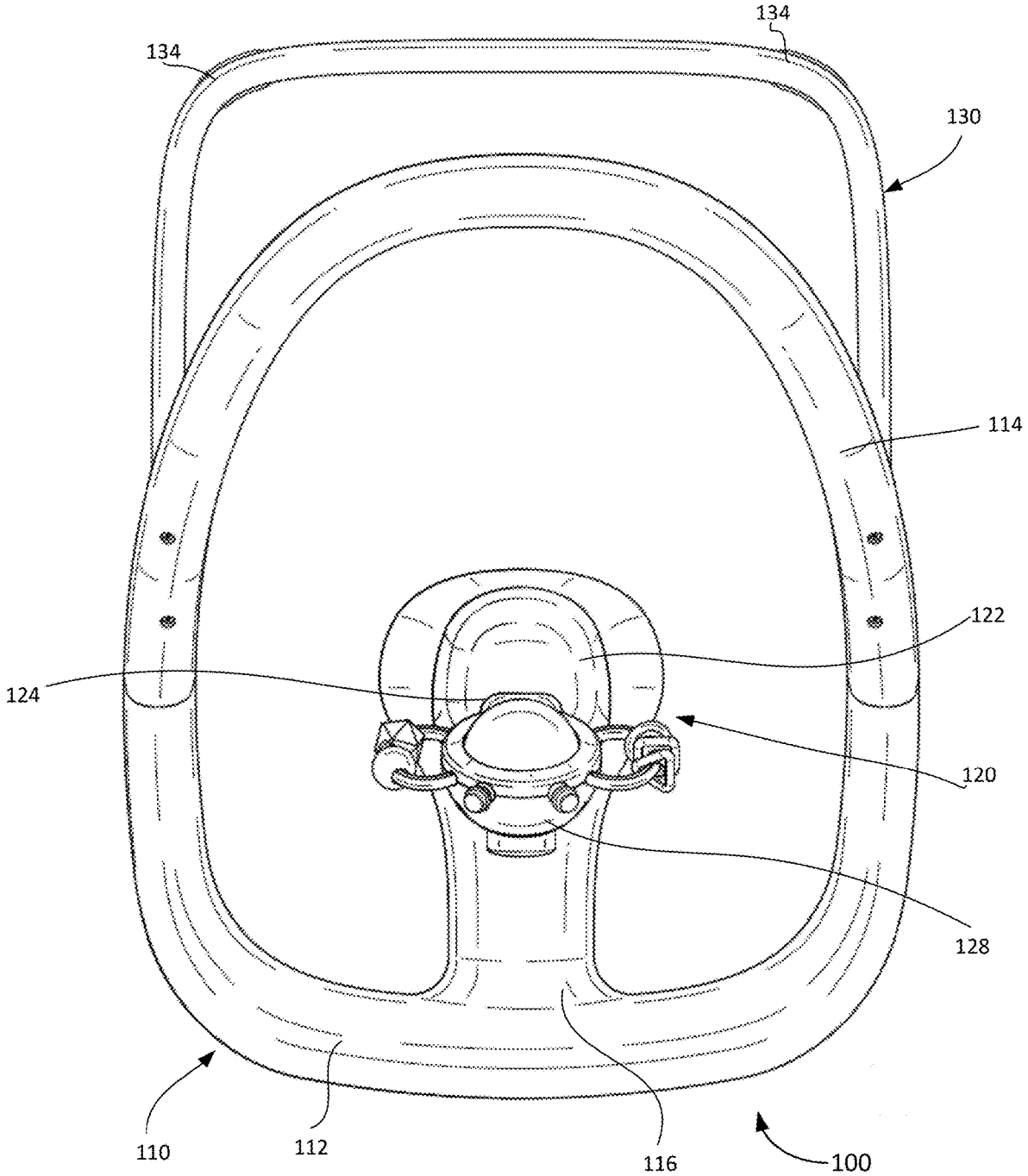
FIG. 6 is a top view of the activity floor seat of FIG. 1.
Figure 7:
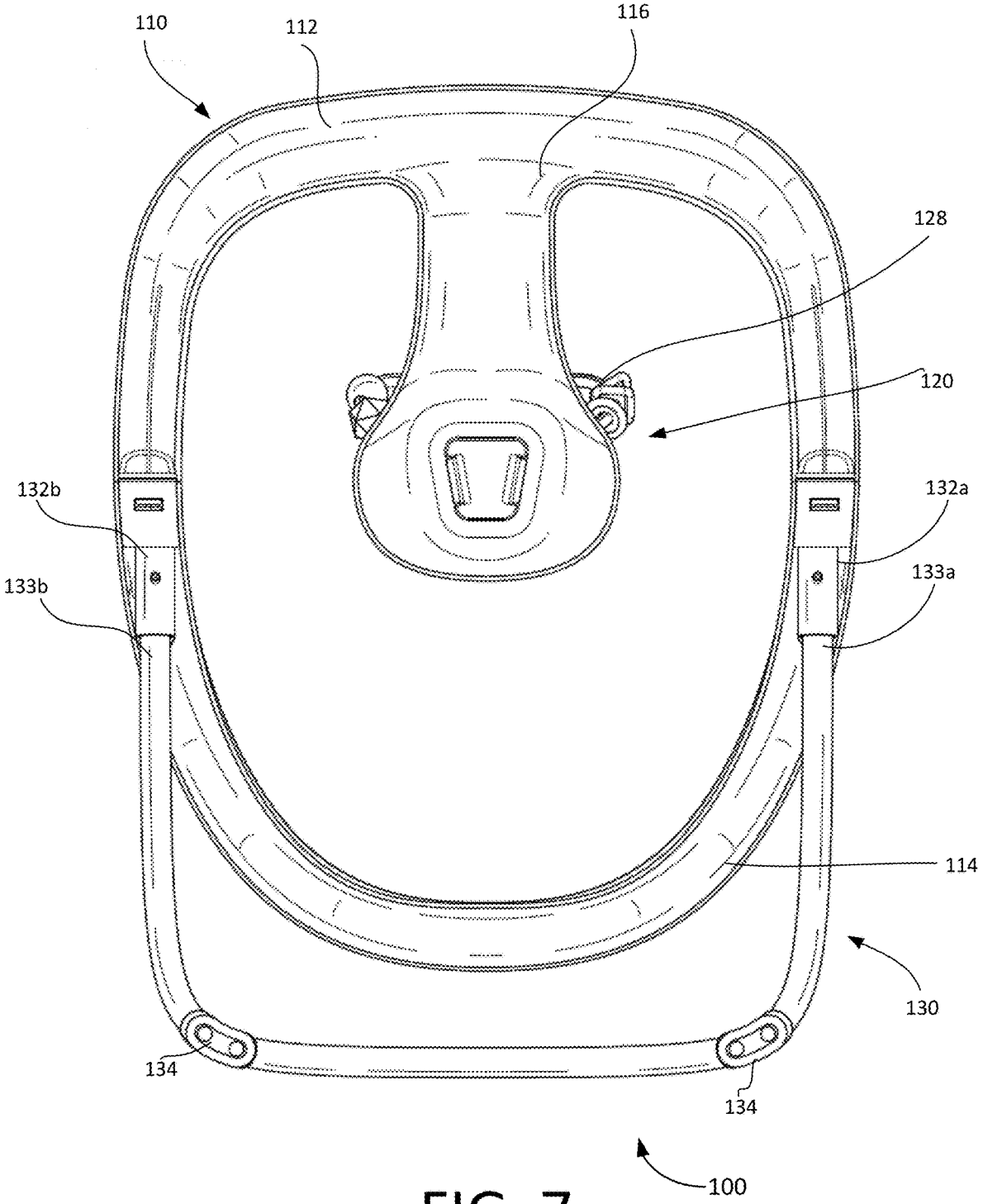
FIG. 7 is a bottom view of the activity floor seat of FIG. 1.

As shown in FIG. 2, when the floor seat 100 is on a level surface, the rear support 130 may be configured and angled such that an angle of the loop structure 110 from the side (notated as Θ in FIG. 2) relative to a floor or surface on which the floor seat 100 is sitting may be anywhere from 30° to 60°, including any of 30°, 35°, 40°, 45°, 50°, 55°, or 60°. This angle may in part be defined by a line extending between the bottom portion of the loop structure 110 that is contacting the surface and the top portion of the loop structure 110 that may be the highest point.

Figure 10:
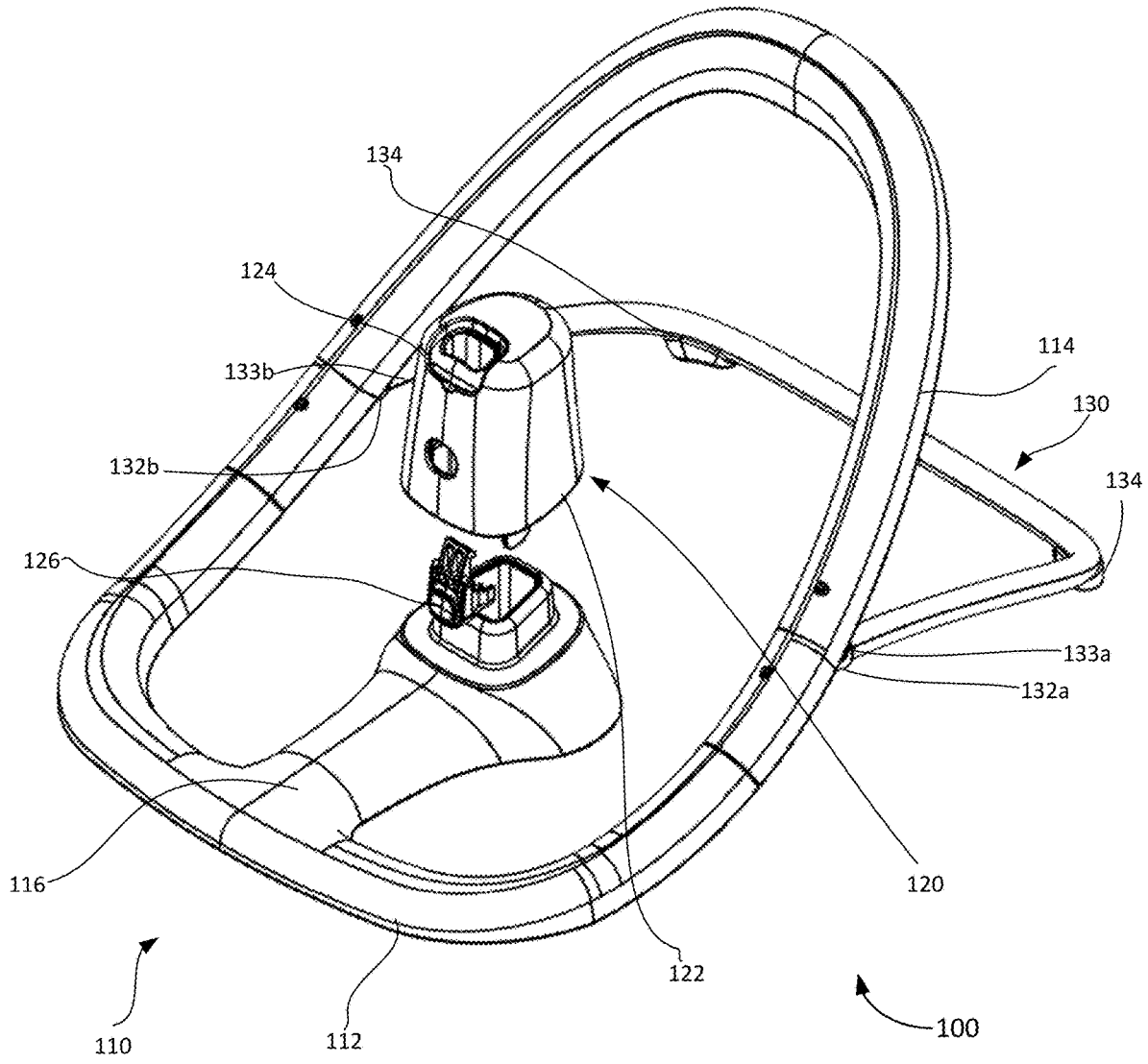
FIG. 10 is a partially exploded view of the activity floor seat of FIG. 1.
Figure 14:
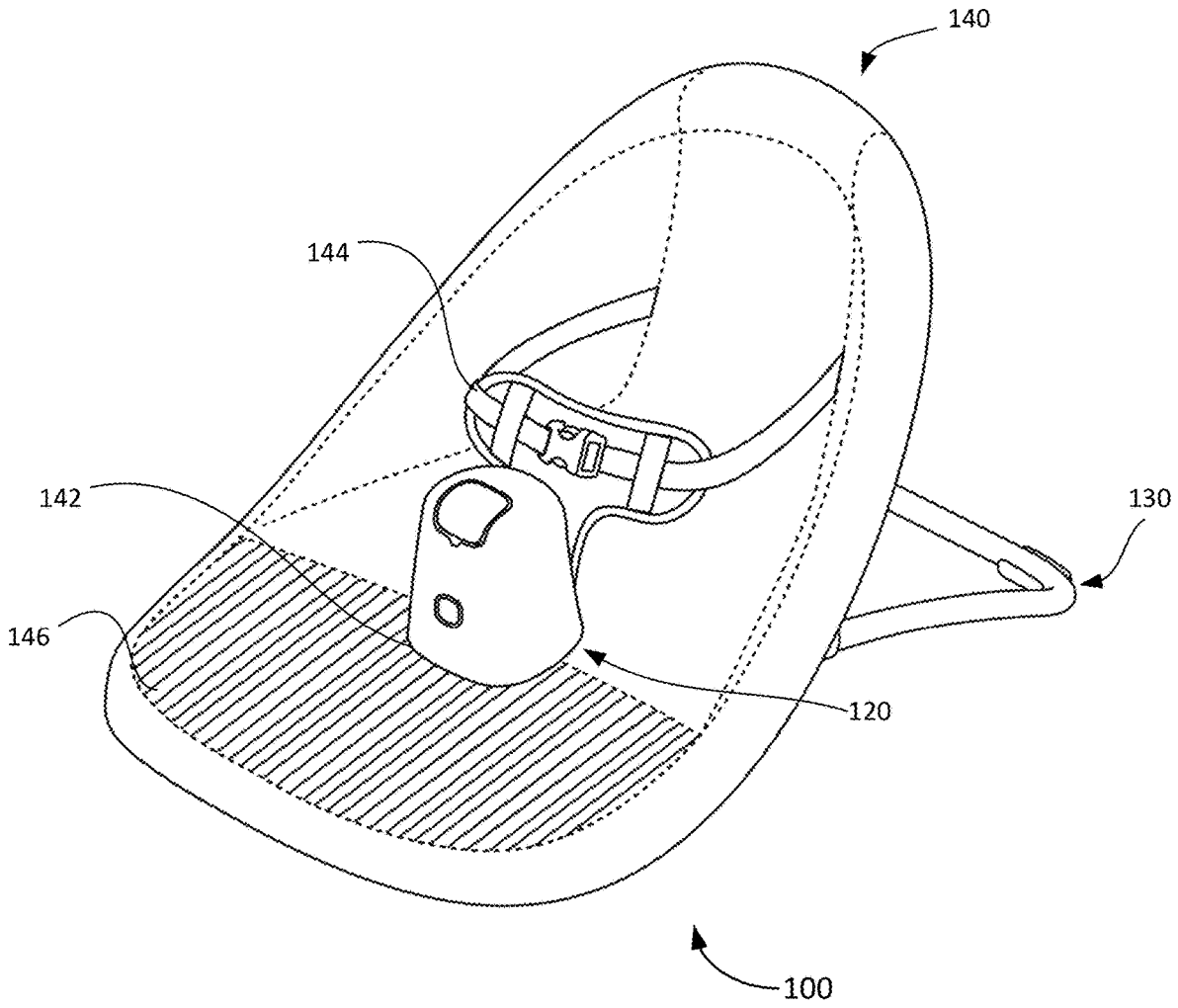
FIG. 14 is a perspective view of the activity floor seat of FIG. 1 with a cover.

The pommel 120 may include a pommel base 122, an accessory slot 124, and a release mechanism 126. As shown in FIGS. 1-7 and 12, the accessory slot 124 may receive an accessory 128. The accessory 128 may be any suitable toy, food tray, cup-holder, writing surface, craft surface, fidget, or other suitable attachment for children, and the positioning of the accessory in the accessory slot 124 may enable the accessory 128 to be immediately accessible to and in front of a seated child. The release mechanism 126, as shown in FIG. 10, may be used to selectively couple the pommel 120 to the base 115. As shown in FIG. 14 and described in depth below, the floor seat 100 may include a cover 140 that may be configured to be positioned between the loop structure 110 and the pommel 120, so the removability of the pommel 120 may facilitate the attachment of the cover 140. The pommel 120 may be sized such that an attached accessory 128 may be positioned at relative chest height of a seated child. For example, the pommel 120 may be between 5-7 inches high relative to the base 115. This positioning of the accessory 128 may encourage the development of arm and shoulder muscles.

Figure 8:
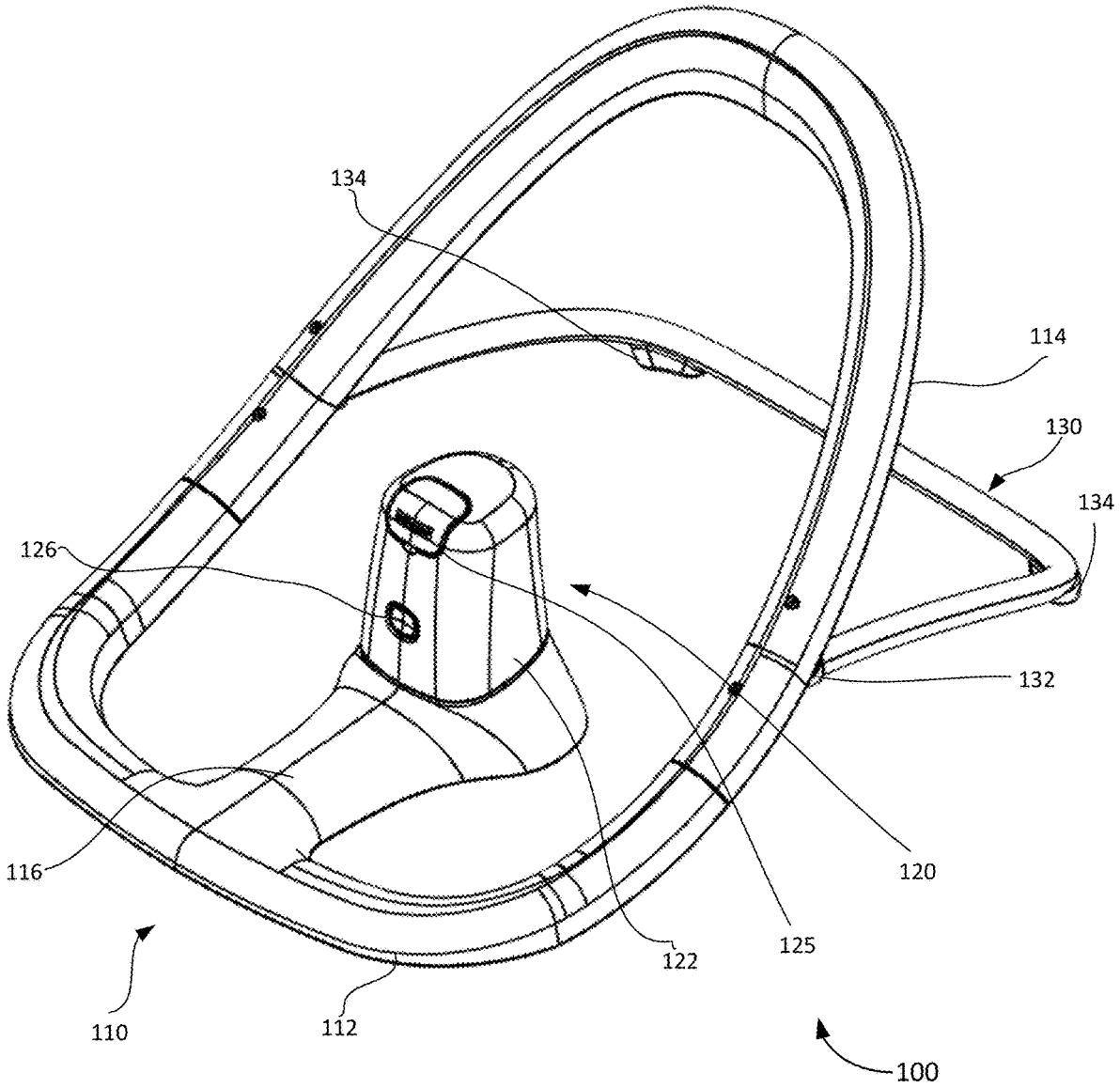
FIG. 8 is a perspective view of the activity floor seat of FIG. 1 with an accessory removed.
Figure 9:
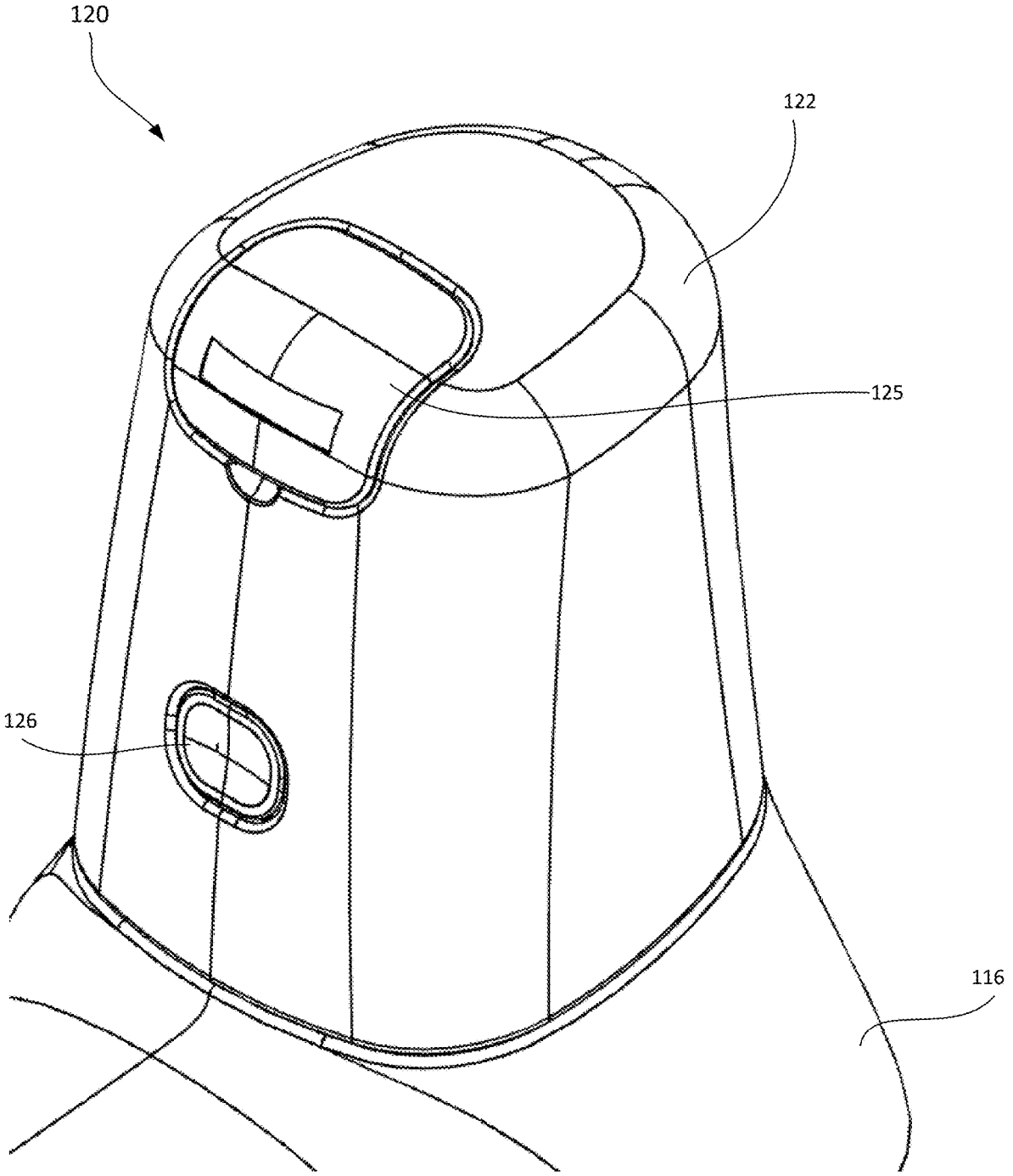
FIG. 9 is a detail view of a pommel of the activity floor seat of FIG. 1.

As shown in FIGS. 8, 9, and 12, the accessory slot 124 may receive a slot cover 125 as an alternative to the accessory 128. In particular, the accessory slot 124 may be configured to receive only one of the slot cover 125 or the accessory 128 at one time, with the slot cover 125 configured to provide a generally-smooth appearance for pummel. As such, the slot cover 125 may be utilized if the floor seat 100 is desired to be used without an accessory 128.

Figure 11:
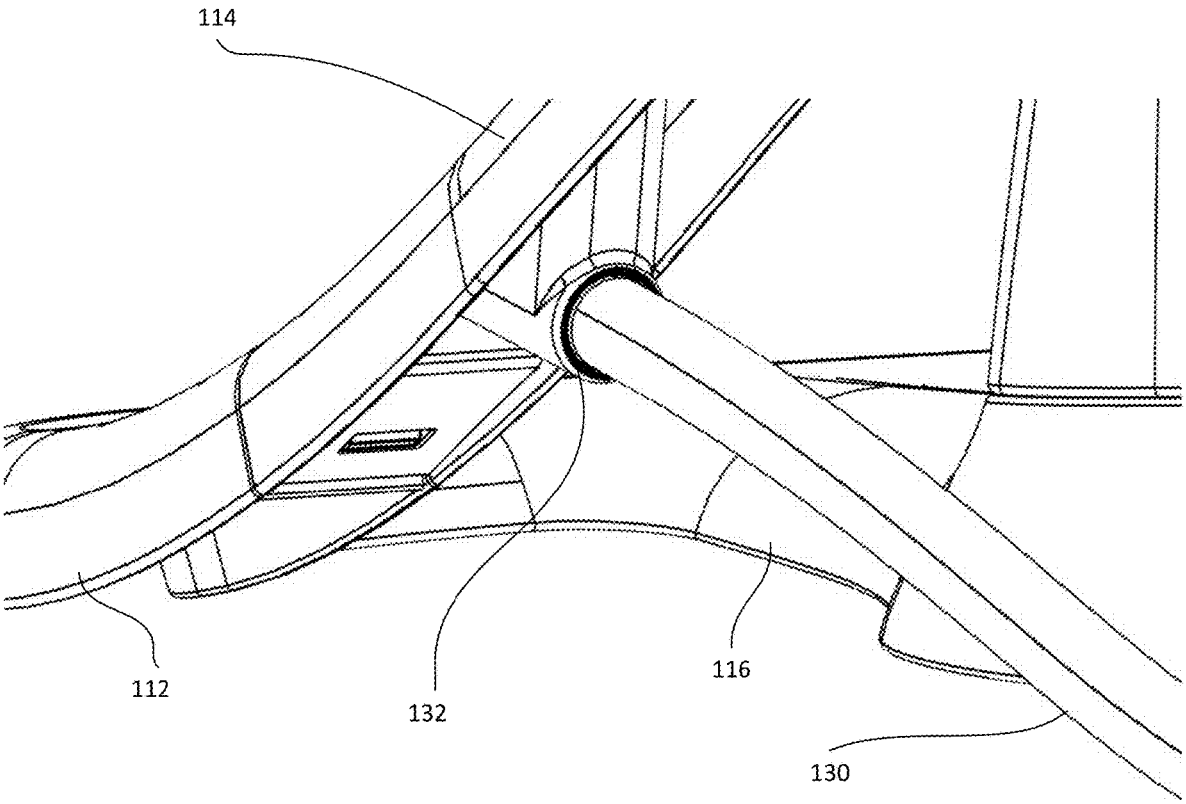
FIG. 11 is a detail view of a connector of activity floor seat of FIG. 1.

The rear support 130 may be substantially U-shaped, and may include a pad 134 at both bends (e.g., corners, curves) of the U-shape. In some embodiments, the rear support 130 may include two separate and substantially linear legs, with the pads 134 fixed at the ends of each leg. Each pad 134 may be configured to provide a point of contact for the rear support 130 with the floor or other surface, and may be formed of rubber, silicone, or similarly-composed material that may provide some shock absorption and/or sliding resistance for the floor seat 100. The rear support 130 may connect to the loop structure 110 (and, specifically, the upper portion 114) via right connector 132*a* and left connector 132*b* (collectively "connectors 132") that are configured to fasten to the upper portion 114 and to receive a right end 133*a* and a left end 133*b*, respectively, of the rear support 130. This interaction is shown in FIGS. 11 and 12. Accordingly, the rear support 130 may connect to the loop structure 110 both on a relatively right side (via the right end 133*a*) and on a relatively left side (via the left end 133*b*) of the loop structure 110. Each of the connectors 132 may be fixed to the loop structure 110 proximate to where the lower portion 112 and the upper portion 114 connect.

Figure 16B:
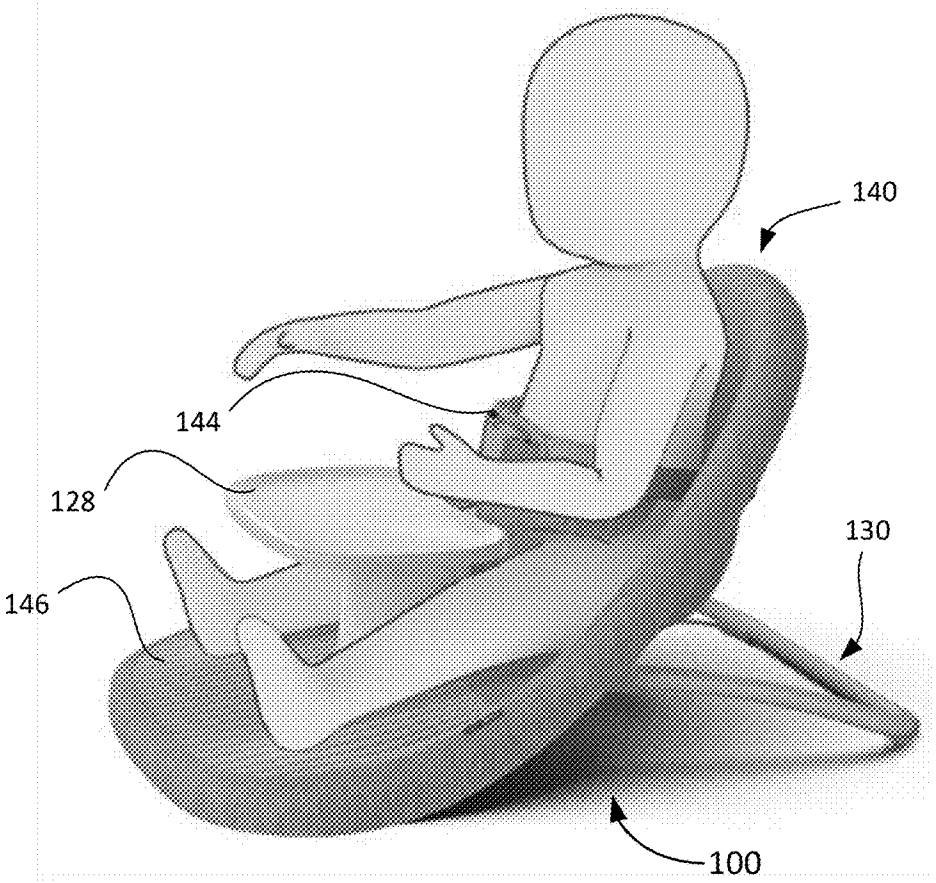
FIG. 16B is a side perspective view of the activity floor seat of FIG. 14 in use.
Figure 16A:
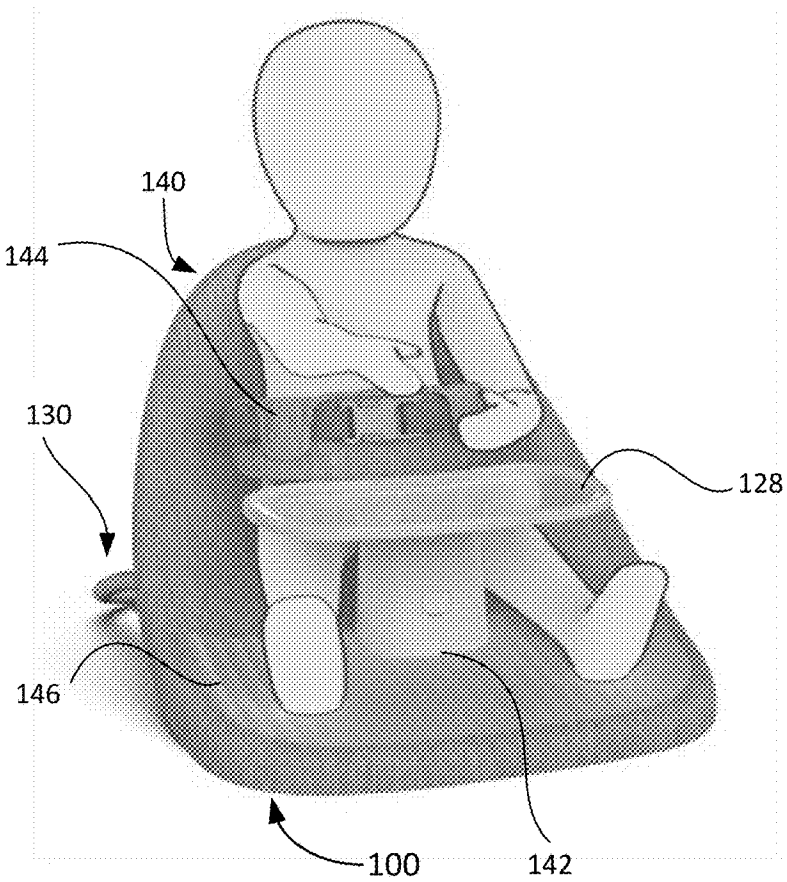
FIG. 16A is a front perspective view of the activity floor seat of FIG. 14 in use.

The activity floor seat 100, by virtue of the shape of the loop structure 110 and the angle by which the rear support 130 connects to and supports the loop structure 110, may encourage proper posture for a seated child. In particular, the relatively gentle (e.g., not abrupt) side supports keep a seated child safely in the seat but encourage full movement of their arms, and the angle of the seat 100 supports a child's core while playing with the chest-high accessory 128. Furthermore, the slight bend upwards in the seat 100 as the forward portion 112 extends into the base 115 causes a seated child's pelvis into a slight anterior tilt, which facilitates lumbar extension and discourages posterior tilt. This is also assisted by the position of the pommel 120 in the middle of the seat 100—and, therefore, in between a seated child's legs—which prevents the seated child from slouching and enables a more open design, as there is nothing directly covering the entirety of the seated child's lap. Accordingly, the seated child is more freely able to rotate their trunk and move their legs, encouraging muscle growth and flexibility. This support and positioning is shown in FIGS. 16A-B, which illustrate a child seated in the seat 100.

Figure 15:
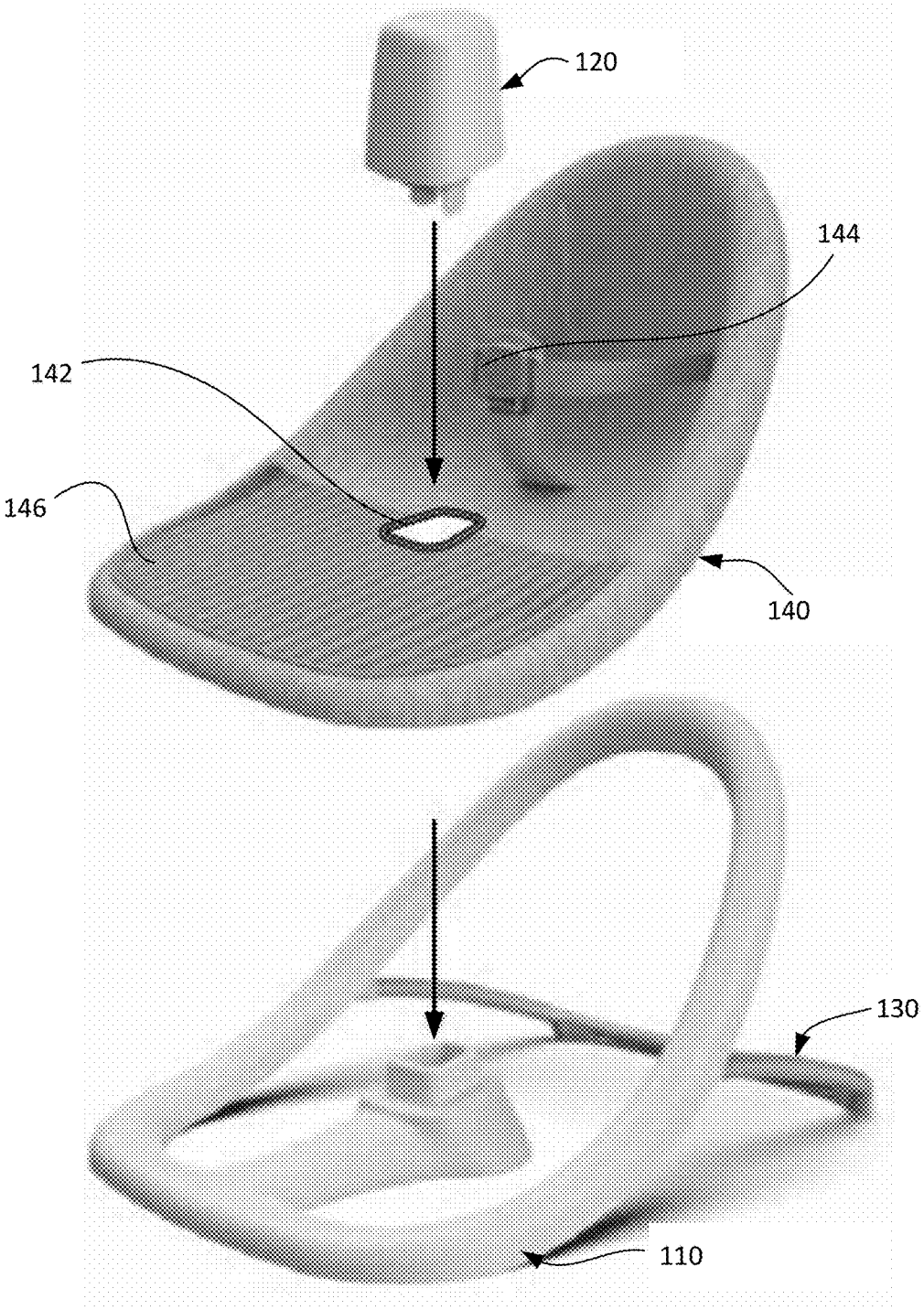
FIG. 15 is a partially exploded view of the activity floor seat of FIG. 14.

As shown in FIGS. 14 and 15, the floor seat 100 may further include a cover 140 configured to fit on and around the loop structure 110 in order to define the seat of the floor seat 100. The cover 140 may include a harness 144 configured to secure a seated child in place on the floor seat 100 and, in coordination with the pommel 120, to keep the seated child ergonomically supported. As shown, the harness 144 includes a buckle with three straps: two that extend laterally from each side of the buckle, and a third that extends downwards as crotch support. This configuration of an open-top harness enables easy removal of the child upwards (e.g., by a parent). However, other configurations for the harness 144 should be considered as within the scope of this disclosure. The cover 140 may also include a texture pad 146 configured to providing a stimulating surface for a seated child's feet in order to encourage sensory exploration for the child's legs and feet.

The cover 140 may be positioned between the loop structure 110 and the pommel 120, such that the cover 140 may be held in place, at least in part, by the pommel 120. To accomplish this, the base portion 115 may include a protrusion that extends upwards, the cover 140 may have a corresponding hole 142 that enables the protrusion to extend upwards through the cover 140, and the pommel 120 couples to the protrusion (e.g., via a snap-fit, etc.) In some embodiments, the cover 140 may be made of fabric or another suitable soft-goods material, such that the cover 140 provides pliable support for a seated child. In some embodiments, the cover 140 may be molded of a hard plastic or similarly-structured material, such that the cover 140 provides firm support. In either of these embodiments, the cover 140 may be supplemented with foam or similar cushion to increase comfort without sacrificing support.

In some embodiments, the cover 140 may be monolithically formed with the loop structure 110, such that the loop structure 110 and the cover 140 are a single piece that, when coupled to the rear support 130, form the seat 100. In further embodiments, the pommel 120 may also be monolithically formed with the loop structure 110 and cover 140, such that the pommel 120 is fixed in place and not removable.

Thus, various embodiments provide for a floor-level activity seat that may be utilized with multiple accessories to accommodate different children. In particular, the activity floor seat may position the accessories directly in front of a seated child, such that the activity seat provides a dual-function of a chair and a toy. In particular, the positioning of the pommel and attached toy at relative chest height (e.g., elevated 5-7 inches relative to the seat) for a seated child promotes fine motor control and the development of arm and shoulder muscles by encouraging reaching, grasping, and general dimensional exploration. Additionally, the activity floor seat may include a removable cover that improves cleaning and other maintenance of the activity floor seat without sacrificing comfort. The cover may include a hole to accommodate attachment of the pommel even while the cover is in place. As such, the activity floor seat combines the functionality of the pommel with the functionality of the cover without impinging on the utility of either. Furthermore, the activity floor seat may provide an innovative support structure via the substantially-fixed (e.g., not rocking or otherwise moving) connection with a curved rear support bar. By attaching to both sides of the central loop structure, the rear support provides horizontal or rotational (e.g., to prevent side-to-side tipping or movement) support, as well as support preventing the seat from falling backwards. The rear support may accomplish all of this without any sharp corners, which are dangerous for children. In addition, the specific angle provided by the activity floor seat is advantageously designed to promote hip abduction of 15-30° and external rotation of 5-15°, which are both in the healthy range for a growing child.

Figure 13:
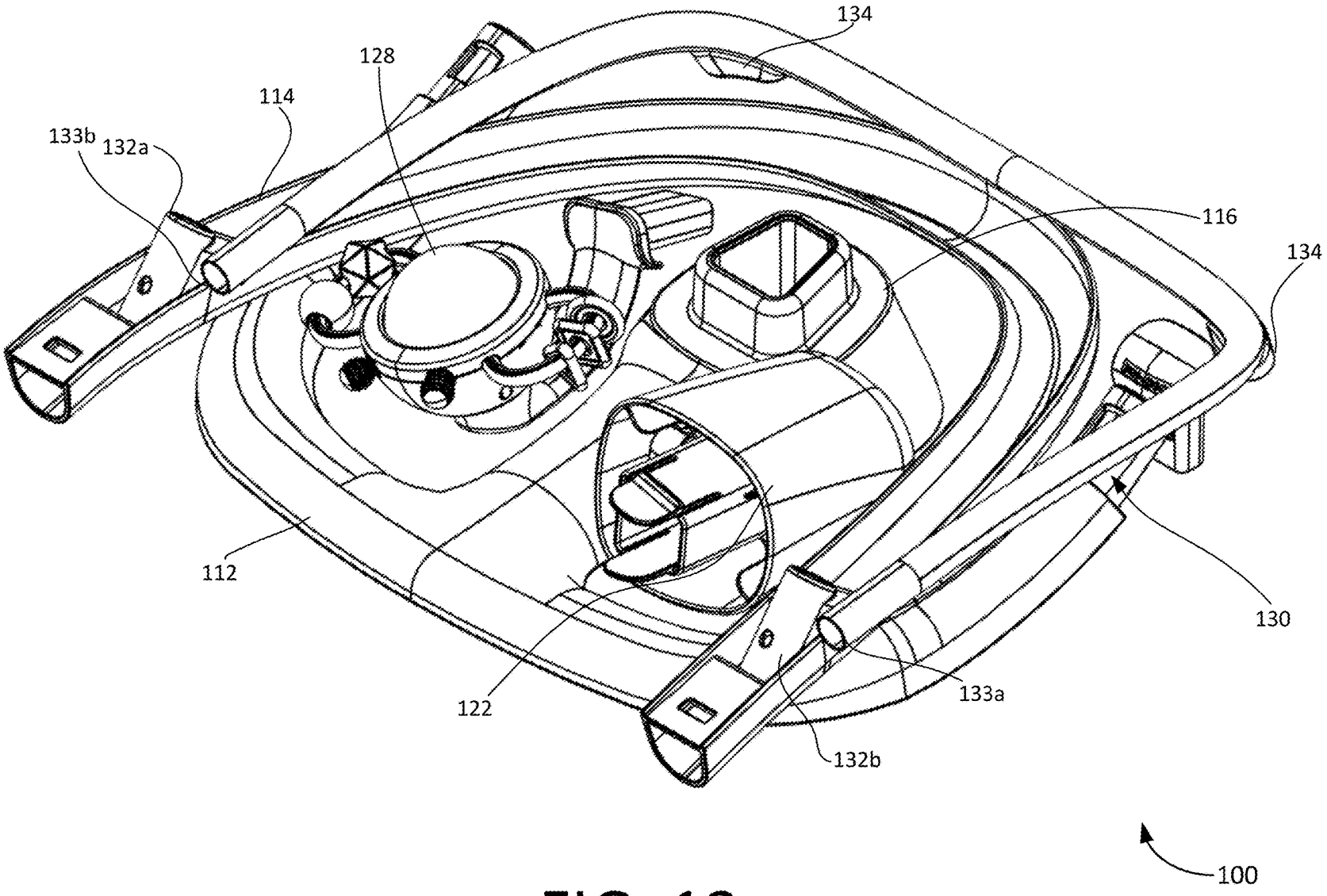
FIG. 13 is a disassembled view of the activity floor seat of FIG. 1.

In addition, and as partially demonstrated by the exploded view of FIG. 12 and the disassembled view of FIG. 13, the floor seat described herein is advantageously easy-to-disassemble. Although some of the "explosion" of FIG. 12 is exaggerated for clarity, each of the lower portion 112, upper portion 114, pommel 120, accessory 128, and rear support 130 are separable and configured such that the separate parts may be stored in a substantially-flat orientation. By being easy-to-disassemble, the floor seat as described herein provides an improvement by having a reduced footprint and packaging size, which saves money on shipping, warehouse, and takes up less shelf space in a store. Such a small footprint is also advantageous for an end user because the chair can be stored in a smaller space when not in use.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An apparatus comprising:

a central structure having a loop portion and a base portion, wherein the loop portion comprises a first portion and a second portion, the first portion is contiguous with the base portion and, with the base portion, is substantially W-shaped, and the second portion is substantially U-shaped;

a pommel coupled to the base portion and positioned within the loop portion; and a cover configured to couple to the loop portion to define a seat, the cover positioned between the base portion and the pommel.

2. The apparatus of claim 1, wherein the pommel comprises an accessory slot configured to receive an accessory.

3. The apparatus of claim 1, wherein:

the base portion comprises an aperture configured to receive the pommel, and the aperture is accessible through an opening in the cover while the cover is coupled to the loop portion.

4. The apparatus of claim 1, wherein the cover comprises a soft-goods material.

5. The apparatus of claim 1, further comprising a rear support bar coupled to the loop portion proximate to a point of connection between the first portion and the second portion.

6. The apparatus of claim 5, wherein the rear support bar is substantially U-shaped and couples to the loop portion at two separate points.

7. The apparatus of claim 5, wherein the first portion, the base portion, and the rear support bar are substantially planar.

8. An activity seat comprising:

a loop structure having a top side, a bottom side, a left side, and a right side; and a support bar extending rearwards from the loop structure, the support bar being substantially U-shaped and having a right end, a left end, and a base portion, wherein:

the bottom side is contiguous with the base portion and, with the base portion, is substantially W-shaped, the top side is substantially U-shaped, the right end of the support bar couples to the right side of the loop structure, the left end of the support bar couples to the left side of the loop structure, and the bottom side of the loop and the base portion of the support bar are together configured to rest on a surface to support the activity seat.

9. The activity seat of claim 8, further comprising:

a right connector fixed to the right side of the loop structure and configured to receive the right end; and a left connector fixed to the left side of the loop structure and configured to receive the left end.

10. The activity seat of claim 8, wherein the support bar further comprises at least one pad comprising a shock-absorbent material.

11. The activity seat of claim 8, wherein the support bar is configured to position the loop structure at an angle between 30-60° relative to the surface while the support bar and the bottom side of the loop structure are resting on the surface.

12. The activity seat of claim 8, wherein the loop structure further comprises a base configured to receive a pommel.

13. The activity seat of claim 12, further comprising a fabric cover configured to couple to the loop structure in order to define a floor-level seat, the fabric cover positioned between the base and the pommel.

14. A floor-level activity seat comprising:

a central structure having a loop portion and a base portion, wherein:

the loop portion comprises a first portion and a second portion;

the first portion is contiguous with the base portion and, with the base portion, is substantially W-shaped; and the second portion is substantially U-shaped;

a support bar extending rearwards from the loop portion, the support bar having a left end coupled to a left side of the loop portion and a right end coupled to a right side of the loop portion;

a pommel coupled to the base portion and positioned within the loop portion; and a fabric cover configured to removably couple to the loop portion to define a seat, the fabric cover positioned between the base portion and the pommel.

15. The floor-level activity seat of claim 14, wherein:

the base portion comprises an aperture configured to receive the pommel, and the aperture is accessible through an opening in the fabric cover.

16. The floor-level activity seat of claim 14, wherein the support bar is substantially U-shaped.

17. The floor-level activity seat of claim 14, wherein a bottom of the loop portion, the base portion, and a bottom of the support bar are substantially planar.

18. The floor-level activity seat of claim 14, wherein the pommel comprises a slot configured to receive an accessory.

19. The floor-level activity seat of claim 14, wherein:

the loop portion comprises a first portion and a second portion, the first portion is monolithic with the base portion and, with the base portion, is substantially W-shaped, and the second portion is substantially U-shaped.

* * * * *